US006712913B2

(12) United States Patent
Hirata et al.

(10) Patent No.: US 6,712,913 B2
(45) Date of Patent: Mar. 30, 2004

(54) FERRITIC HEAT-RESISTING STEEL

(75) Inventors: Hiroyuki Hirata, Neyagawa (JP); Kazuhiro Ogawa, Nishinomiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/358,330

(22) Filed: Feb. 5, 2003

(65) Prior Publication Data

US 2003/0140986 A1 Jul. 31, 2003

Related U.S. Application Data

(63) Continuation of application No. PCT/JP02/04446, filed on May 7, 2002.

(30) Foreign Application Priority Data

May 9, 2001 (JP) ..... 2001-138624

(51) Int. Cl.[7] ..... C22C 38/24; C22C 38/26
(52) U.S. Cl. ..... 148/325; 148/333; 148/335
(58) Field of Search ..... 148/325, 332, 148/334, 336; 420/37–41, 60, 64, 67–69

(56) References Cited

U.S. PATENT DOCUMENTS

| | | | | | |
|---|---|---|---|---|---|
| 4,799,972 | A | * | 1/1989 | Masuyama et al. | 148/605 |
| 5,240,516 | A | * | 8/1993 | Iseda et al. | 148/325 |
| 5,591,391 | A | * | 1/1997 | Igarashi et al. | 420/38 |
| 6,113,710 | A | * | 9/2000 | Kato et al. | 148/325 |

FOREIGN PATENT DOCUMENTS

| | | | |
|---|---|---|---|
| JP | 02-310340 | | 12/1990 |
| JP | 04-006213 | | 1/1992 |
| JP | 04-350118 | | 12/1992 |
| JP | 04-354856 | | 12/1992 |
| JP | 05-043986 | | 2/1993 |
| JP | 05-263196 | | 10/1993 |
| JP | 05-311342 | | 11/1993 |
| JP | 05-311343 | | 11/1993 |
| JP | 05-311344 | | 11/1993 |
| JP | 05-311345 | | 11/1993 |
| JP | 05-311346 | | 11/1993 |
| JP | 06-065689 | | 3/1994 |
| JP | 07-242935 | | 9/1995 |
| JP | 07-286239 | * | 10/1995 |
| JP | 08-085848 | | 4/1996 |
| JP | 08-337813 | | 12/1996 |
| JP | 09-013150 | | 1/1997 |
| JP | 09-071845 | | 3/1997 |
| JP | 11-106860 | | 4/1999 |
| JP | 11-172369 | | 6/1999 |
| JP | 2000-204434 | | 7/2000 |
| JP | 2000-226642 | | 8/2000 |

* cited by examiner

*Primary Examiner*—Deborah Yee
(74) *Attorney, Agent, or Firm*—Clark & Brody

(57) ABSTRACT

A ferritic heat-resisting steel that shows a slight decrease in creep strength at the heat affected zone of the welded joint. The steel is characterized by consisting of, by mass %, C: less than 0.05%, Si: not more than 1.0%, Mn: not more than 2.0%, P: not more than 0.030%, S: not more than 0.015%, Cr: 7–14%, V: 0.05–0.40%, Nb: 0.01–0.10%, N: not less than 0.001% but less than 0.050%, sol. Al: not more than 0.010%, and O (oxygen): not more than 0.010%, with the balance being Fe and impurities, and further characterized in that the density of carbide and carbonitride precipitates contained with a grain diameter of not less than 0.3 $\mu$m is not more than $1\times10^6/mm^2$. This steel may further contain one or more of the following elements: a total of 0.1–5.0% of Mo and W; a total of 0.02–5.00% of Cu, Ni and Co; a total of 0.01–0.20 of Ta, Hf, Nd and Ti; a total of 0.0005–0.0100% of Ca and Mg; and 0.0005–0.0100% of B.

6 Claims, No Drawings

FERRITIC HEAT-RESISTING STEEL

This application is a continuation of International Patent Application No. PCT/JP02/04446, filed May 7, 2002. This PCT application was not in English as published under PCT Article 21(2).

TECHNICAL FIELD

This invention relates to a ferritic heat-resisting steel showing a low level of softening in the welding heat affected zone.

BACKGROUND ART

Among high-temperature materials for use in heat and pressure resisting piping systems in boilers, chemical plants and so forth, there are low Cr ferritic steels, typically 2·¼Cr-1Mo steel, high Cr ferritic steels, typically 9Cr-1Mo steel, and austenitic stainless steels, typically 18Cr-8Ni steel.

Among them, high Cr ferritic steels are superior to low Cr ferritic steels in strength and corrosion resistance in the temperature range of 500–600° C. High Cr ferritic steels are also superior to austenitic stainless steels in price and stress corrosion cracking resistance. Furthermore, high Cr ferritic steels have a low coefficient of thermal expansion and show smaller strains in response to temperature changes. Thus, high Cr ferritic steels, which have many advantages as materials for use at high temperatures, are currently in wide use.

In recent years, the environment for use thereof has become increasingly severe, and accordingly, the use performance requirements that are imposed on heat-resisting ferritic steels, in particular the creep strength requirement, have become much larger. Therefore, a number of improvements have been proposed. Those are new heat-resisting ferritic steels based on ferritic steels containing 8–13% of Cr and improved in strength at elevated temperatures by adjusting the content of Mo, W, Nb, V as well as Co, Ta, Nd, Zr, B and so forth, and a number of methods for heat treatment thereof (cf. e.g. Japanese laid-open patent specifications (JP Kokai) Nos. H02-310340, H04-6213, H04-350118, H04-354856, H05-263196 and H05-311342 to 311346).

It is known that when heat-resisting ferritic steels are used in welded structures, the creep strength of welded joints declines by 20% or more in the heat affected zone (HAZ). The phenomenon is called "HAZ softening", which is described for example in "Science and Technology of Welding and Joining, 1996, Vol. 1, No. 1, pp. 36–42".

However, as for the ferritic steels and the methods of production thereof as disclosed in the above-cited publications, the main objective is to improve the creep strength and/or toughness of the base metals. No attention has been paid at all to the decreases in creep strength of welded joints as a result of the HAZ softening phenomenon.

For suppressing the HAZ softening phenomenon, a number of heat-resisting ferritic steels and methods of production thereof have also been proposed (cf e.g. JP Kokai H05-43986, H06-65689, H07-242935, H08-85848, H08-337813, H09-13150, H09-71845 and H111-106860).

However, the ferritic steels and methods of production as disclosed in those publications require a special melting and/or thermo-mechanical treatment, as shown in JP Kokai H07-242935 or JP Kokai H08-337813 for example and therefore problems arise such as an increase in production cost and/or a decrease in production efficiency. Steels disclosed in JP Kokai H06-65689, H08-85848 and H09-71845 contain Ta oxide particles and such expensive elements as Ta, Nd and/or Hf as essential components and therefore there is the problem of an increase in production cost.

DISCLOSURE OF THE INVENTION

An objective of the present invention is to provide a ferritic heat-resisting steel that is inexpensive and shows only a slight decrease in creep strength in the heat affected zone of welded joints. The steel requires no particular melting or thermo-mechanical treatment and does not always require the addition of expensive Ta oxide particles, Ta, Nd, Hf and the like.

The ferritic heat-resisting steel of the invention is characterized by the following features (A) and (B):

(A) The chemical composition consists of, by mass %, C: less than 0.05%, Si: not more than 1.0%, Mn: not more than 2.0%, P: not more than 0.030%, S: not more than 0.015%, Cr: 7–14%, V: 0.05–0.40%, Nb: 0.01–0.10%, N: not less than 0.001% but less than 0.050%, sol. Al: not more than 0.010%, and O (oxygen): not more than 0.010%, with the balance being Fe and impurities.

(B) The density of carbide and carbonitride precipitates, contained in the steel and having a diameter of not less than 0.3 $\mu$m, is not more than $1\times10^6/mm^2$.

The ferritic heat-resisting steel of the invention may contain at least one component selected from one or more groups given below, in lieu of part of Fe in the composition (A) mentioned above.

First group: a total content of 0.1–5.0 mass % of Mo and W.

Second group: a total content of 0.02–5.00 mass % of Cu, Ni and Co.

Third group: a total content of 0.1–0.20 mass % of Ta, Hf, Nd and Ti.

Fourth group: a total content of 0.0005–0.0100 mass % of Ca and Mg.

Fifth group: 0.0005–0.0100 mass % of B.

The inventors paid attention to micro-structural changes due to thermal cycles in welding and carried out repeated experiments and investigations. As a result, they obtained the following new findings and have now completed the present invention.

First, it was revealed that HAZ softening occurs according to the following mechanisms. In the production of base metals, $M_{23}C_6$ type carbides (in this case, M being such a metal element as Cr, Mo or W) or MX type carbonitrides (in this case, M being such a metal element as V or Nb, and X representing C and N) precipitate. Among them the $M_{23}C_6$ type carbides, containing a large amount of Cr as a solid solution, are coarse as compared with the MX type carbonitrides, and they are partly decomposed by thermal cycles at the welding stage and dissolved and contained as a solid solution in the matrix. During the subsequent heat treatment (post-welding heat treatment) and in the earlier stage of creep, the Cr contained as a solid solution in a supersaturated condition again finely precipitates from the matrix regions, wherein said part of $M_{23}C_6$ type carbides have become solid solution. Therefore, compared with the base metal (where the partial dissolution of carbides as solid solution does not occur) which is not subjected to welding thermal cycles or the part where the HAZ softening does not occur (where the partial dissolution of carbides as solid solution does not occur, or the carbides are completely decomposed and dissolved as solid solution), the density and size of $M_{23}C_6$ type carbide precipitates which contain Cr as a main component become uneven or irregular in the HAZ. During use, the precipitation of the above-mentioned Cr solid-soluted in a supersaturated condition becomes complete, and after arrival of the Cr concentration in the base metal at an equilibrium concentration, the particles become coarse due to the disappearance of finer particles. Thus, Cr-based fine $M_{23}C_6$ type carbides disappear, and the Cr is fed to the surrounding $M_{23}C_6$ type carbides to promote the growth thereof, or the Cr re-precipitates and grows utilizing MX type carbonitrides as nuclei. The rate of growth of $M_{23}C_6$ type carbides and MX type carbonitrides increase. As a result, the effect of dispersion strengthening by fine MX type carbonitrides, which greatly contribute to strengthening, is impaired at an early stage, whereupon the strength decreases.

Based on the above findings, the inventors made detailed investigations in search of a method of preventing the HAZ softening, and as a result, it was confirmed that the following measures are effective in preventing the HAZ softening.

(a) Reducing the amount of coarse precipitates (mainly Cr-containing $M_{23}C_6$ type carbides) existing in the steel before welding, and thereby increasing uniformity in the size of precipitates as resulting from said partial solid solution due to welding thermal cycles.

(b) For reducing the amount of coarse $M_{23}C_6$ type carbide precipitates, it is very effective to reduce the contents of C and N, which lower the activity of Cr.

(c) Reductions in C and N content are effective in increasing the equilibrium Cr concentration in the base metal, and retarding the rate of growth of precipitates ($M_{28}C_6$ type carbides and MX type carbonitrides) in the process of coarsening thereof, after completion of the precipitation of $M_{23}C_6$ type carbides and arrival of the Cr concentration in the base metal at an equilibrium concentration during use.

More specifically, it was confirmed that the decrease in strength in the HAZ can be prevented by reducing the density of $M_{23}C_6$ type carbide and MX type carbonitride precipitates with a diameter (major axis) of not less than 0.3 $\mu$m to not more than $1\times10^6/mm^2$, and by reducing the content of C and N respectively to a level lower than 0.05%.

The above findings (a), (b) and (c) are quite different from the technical idea in the inventions disclosed in the above-cited JP Kokai H05-43986 and H08-85848 wherein intentional addition of C and N is necessary to secure creep strength. The above findings also differ from the technical idea in the invention disclosed in JP Kokai H07-242935 wherein causing a large amount of fine $M_{23}C_6$ type carbides (specifically $Cr_{23}C_6$) to precipitate is necessary.

BEST MODES FOR CARRYING OUT THE INVENTION

The ferritic heat-resisting steel of the invention is characterized in that it satisfies the above-mentioned conditions (A) and (B). The grounds for specifying the chemical composition and the size and precipitation density of $M_{23}C_6$ type carbides and MX type carbonitrides are as follows. In the following description, means "% by mass".

I. Chemical Composition

C: less than 0.05%

C has been regarded as an element forming $M_{23}C_6$ type carbides and contributing to improved strength at elevated temperatures. However, as mentioned above, some $M_{23}C_6$ type carbides become solid solution upon welding and reprecipitate as coarse $M_{23}C_6$ type carbides during the subsequent heat treatment and in the earlier stage of creep process, causing irregularity in size and the HAZ softening. Therefore, for reducing the amount of $M_{23}C_6$ type carbide precipitates before welding and providing the long-term strength of the HAZ, namely for preventing the HAZ softening, it is effective to reduce the C amount as much as possible. Thus, the C amount should be less than 0.05%, and preferably not more than 0.045%. The lower limit is not particularly prescribed. However, C is an element effective in forming fine MX type carbonitrides, which have a dispersion strengthening effect, and such an effect can be obtained when its content is not less than 0.001%. Therefore, not less than 0.001% of C may be contained in the steel when this effect is desired.

Si: not more than 1.0%

Si is added as a deoxidizer at the steel making stage. Si is also an element that improves the oxidation resistance and high-temperature corrosion resistance. However, excessive addition causes creep embrittlement and a decrease in toughness. Therefore, the Si amount should be not more than 1.0%, and preferably not more than 0.8%. In cases where deoxidation is realized to a sufficient extent by Mn and/or Al to be mentioned later, no intentional addition of Si is necessary, hence the lower limit of the amount of Si is not prescribed in particular. However, for ensuring the deoxidizing effect with Si, it is desirable that the Si amount be not less than 0.03%.

Mn: not more than 2.0%

Like the above-mentioned Si, Mn is added as a deoxidizer at the steel-making stage. Mn is an austenite-forming element and is also effective in obtaining a martensitic structure. However, an excessive amount thereof causes creep embrittlement and decreases in creep strength. Therefore, the Mn amount should be not more than 2.0%, and preferably not more than 1.8%. In cases where deoxidation is realized to a sufficient extent by the above-mentioned Si and/or Al to be mentioned later, no intentional addition of Mn is necessary, hence the lower limit is not prescribed in particular. However, for ensuring the deoxidizing effect with Mn, it is desirable that the Mn amount be not less than 0.03%.

P: not more than 0.30%

P is an impurity contained in the steel. When its content is excessive, it causes grain boundary embrittlement. Therefore, the upper limit thereof should be 0.030%. The P amount should be as low as possible.

S: not more than 0.15%

Like P mentioned above, S is an impurity element contained in the steel, and when its amount is excessive it causes grain boundary embrittlement. Therefore, the upper limit thereof should be set at 0.015%. The S amount also should be as low as possible.

Cr: 7–14%

Cr is an element effective in providing oxidation resistance at high temperatures, high-temperature corrosion resistance and strength at elevated temperatures. For obtaining these effects, an amount of not less than 7% is necessary. However, at excessive addition levels, it increases the formation of Cr-based $M_{23}C_6$ type carbides and promotes the rate of growth of carbides, causing decreases in creep strength in the HAZ. Therefore, the upper limit of the Cr amount should be 14%. A Cr amount of 8–13% is more preferable.

V: 0.05–0.40%

V is an element that forms fine MX type carbonitrides, which are stable even at elevated temperatures, and contributes to the improvement of creep strength. For obtaining this effect, an amount of not less than 0.05% is necessary. However, when its amount exceeds 0.40%, it causes coarsening of MX type carbonitrides and the strength improving effect owing to fine dispersion thereof is lost at an early stage, and in addition, it causes a decrease in toughness. Therefore, the upper limit of the V content should be 0.40%, and 0.10–0.30% is more preferable.

Nb: 0.01–0.10%

Nb, like the above-mentioned V, forms fine MX type carbonitrides, which are stable even at elevated temperatures, and contributes to the improvement of creep strength. An amount of not less than 0.01% is necessary in order to obtain this effect. However, when its amount exceeds 0.10%, it causes coarsening of MX type carbonitrides and the strength improving effect owing to fine dispersion thereof is lost at an early stage, and in addition, it causes a decrease in toughness. Therefore, the upper limit of the Nb amount should be 0.10%, and 0.02–0.08% is more preferable.

N: not less than 0.001% but less than 0.050%

As with C mentioned above, N is effective in reducing the activity of Cr, and promotes the precipitation of $M_{23}C_6$ type carbides and promotes the HAZ softening. Therefore, N content should be reduced as much as possible. The upper limit of the N content is less than 0.050%. On the other hand, N is also an element that forms MX type carbonitrides, in which V and Nb are contained as a solid solution, thus producing the fine dispersion strengthening effect thereof For obtaining such an effect, content of not less than 0.001% is necessary. For these reasons, N content should be not less than 0.001% but less than 0.050%. 0.003–0.045% is more preferable.

sol. Al: not more than 0.010%

Al is added as a deoxidizer at the steel-making stage but an excessive addition causes a decrease in the steel's cleanliness. Therefore, the sol.Al content should be not more than 0.010%, and preferably not more than 0.008%. In cases where the above-mentioned Si and/or Mn realize deoxidation to a sufficient extent, no intentional addition of Al is necessary; hence the lower limit of the Al content is not prescribed in particular. However, for ensuring the deoxidizing effect with Al, it is desirable that the sol. Al content be not less than 0.003%.

O (oxygen): not more than 0.010%

O (oxygen) is an impurity contained in steel. When it is contained in excess, it causes a decrease in the steel's cleanliness, and in addition causes a decrease in creep strength. Therefore, the O content should be not more than 0.010%. O content should be as low as possible.

The remaining portion, other than the above alloying elements and impurities, is substantially accounted for by Fe. However, where necessary the following components may be added in lieu of part of Fe.

Mo, W:

The intentional addition of these elements is not always necessary. However, when added, both elements are effective in solid solution hardening of the matrix, and furthermore precipitate as intermetallic compounds, contributing to an improvement in creep strength. Therefore, when such an effect is desired, one or both may be added intentionally and the effect becomes significant at a total amount of not less than 0.1%. However, when the total amount exceeds 5.0%, the amount of coarse intermetallic compounds increases, causing a decrease in toughness. Therefore, when these elements are added, the total amount should be 0.1–5.0%. A preferred total amount is 0.5–4.5%.

Cu, Ni, Co:

The intentional addition of these elements is not always necessary. When added, they contribute to martensitic matrix structure formation because they are all austenite-forming elements. Therefore, when such an effect is desired, one or more of them may be added intentionally. The effect becomes significant at a total amount of not less than 0.02%. However, when the total amount exceeds 5.00%, the creep ductility is markedly reduced. Therefore, when they are added, the total amount of these elements should be 0.02–5.00%, and preferably 0.05–4.50%.

Ta, Hf, Nd, Ti:

The intentional addition of these elements is not always necessary. When added, all the elements such as the above-mentioned V and Nb form MX type carbides and contribute to an improvement in creep strength. Therefore, when such an effect is desired, one or more of them may be added. The effect becomes significant at a total amount of not less than 0.01%. However, when the total amount exceeds 0.20%, the carbides become coarse and the cleanliness of the steel deteriorates, and the toughness is impaired. Therefore, when they are added, the total amount of these elements should be 0.01–0.20%, and preferably 0.03–0.18%.

Ca, Mg:

The intentional addition of these elements is not always necessary. When added, both of these elements improve the hot workability of the steel. Therefore, when such an effect is desired, one or both may be added intentionally. The effect becomes significant at a total amount of not less than 0.0005%. However, when the total amount exceeds 0.0100%, the cleanliness of the steel is impaired. Therefore, when they are added, the total amount of these elements should be 0.0005–0.0100%, and preferably 0.0010–0.0080%.

B:

It is not always necessary to add B intentionally. When added, it disperses and stabilizes carbides and contributes to the improvement in creep strength of the base material. B is also an element improving hardenability of the steel and is effective in rendering the structure of the base metal martensitic. Therefore, when these effects are desired, it may be added intentionally. The effects become significant at a level of not less than 0.0005%. However, when the content exceeds 0.0100%, the high-temperature crack resistance during welding is impaired. Therefore, when B is added, content of 0.0005–0.0100% is recommended, and preferably 0.0010–0.0080%.

II. Sizes and Amount of $M_{23}C_6$-Based Carbides and MX Type Carbonitrides in the Steel As mentioned hereinabove, the decrease in creep strength in the HAZ is caused by the following process; Carbides, mainly coarse $M_{23}C_6$ type carbides, which have precipitated in the step of base metal production, become solid solution partly during thermal cycles in the step of welding. Fine carbides precipitate again from the regions containing said partly solid-solute carbides during the subsequent heat treatment and in the early stage of creep process. Thus, the density and sizes of Cr-based carbide precipitates unevenly compared with the base metal, which has not been subjected to welding thermal cycles or the portions showing no HAZ softening.

In order to prevent said phenomenon, it is effective to restrict the amount of the above-mentioned carbides, mainly $M_{23}C_6$ type carbides, and MX type carbonitrides produced in the base metal before welding, and to reduce the amount of the carbides which solid-solute partly during thermal cycles at the welding stage. For obtaining the effect to a satisfactory extent, it is necessary to reduce the density of precipitates of carbides mainly of the $M_{23}C_6$ type and MX type carbonitrides not smaller than 0.3 $\mu$m in diameter (major axis), in the base metal before welding, to a level not higher than $1\times10^6/mm^2$. The reasons will be shown in examples to be mentioned later.

A structure where the density of precipitates of carbides, mainly $M_{23}C_6$ type carbides, and MX type carbonitrides, not smaller than 0.3 $\mu$m in diameter (major axis), is not higher than $1\times10^6/mm^2$ can be attained by appropriately adjusting the heat treatment temperature and the keeping time in "normalizing" or "normalizing+tempering" during base metal production according to the chemical composition of the steel (for example employing the conditions shown in the examples given later).

EXAMPLES 12-mm-thick steel plates were prepared from 34 ferritic steels with respective having the chemical compositions shown in Table 1 and Table 2. In preparing the steel plates, the steels were melted in a vacuum-melting furnace and formed into plates by casting, hot forging and hot rolling. The plates were normalized by maintaining a temperature range within 900° C. to 1180° C. for 0.5 hour, and then tempered by maintaining a temperature range within 700° C. to 770° C. for 1 to 10 hours. In some examples, the tempering stage was omitted.

During the above procedure, the surface of each plate after hot rolling was examined for defects by visual observation and the hot workability of each stee was evaluated. The hot workability was evaluated as good "◎" when the number of defects per $mm^2$ was 5 or less; no problem "○" when the number was 6 to 20; and poor "X" when the number was 21 or more. The results are also shown in Table 2.

TABLE 1

| | Chemical Composition (mass %, bal.: Fe and impurities) | | | | | | | | | | | | |
|---|---|---|---|---|---|---|---|---|---|---|---|---|---|
| No. | C | Si | Mn | P | S | Cr | V | Nb | N | sol. Al | O | Mo | W |
| | | | | | | Steel of This Invention | | | | | | | |
| 1 | 0.035 | 0.25 | 0.44 | 0.015 | 0.006 | 9.16 | 0.19 | 0.04 | 0.014 | 0.004 | 0.004 | — | — |
| 2 | 0.045 | 0.30 | 0.61 | 0.012 | 0.004 | 9.46 | 0.21 | 0.05 | 0.020 | 0.005 | 0.003 | — | — |
| 3 | 0.020 | 0.28 | 0.41 | 0.012 | 0.004 | 9.25 | 0.22 | 0.05 | 0.018 | 0.006 | 0.004 | — | — |
| 4 | 0.001 | 0.26 | 0.52 | 0.009 | 0.005 | 9.12 | 0.20 | 0.08 | 0.016 | 0.005 | 0.004 | — | — |
| 5 | 0.005 | 0.20 | 0.48 | 0.010 | 0.005 | 9.20 | 0.19 | 0.06 | 0.023 | 0.005 | 0.003 | — | — |
| 6 | 0.016 | 0.19 | 0.47 | 0.013 | 0.006 | 9.23 | 0.17 | 0.06 | 0.028 | 0.004 | 0.004 | — | — |
| 7 | 0.049 | 0.25 | 0.33 | 0.015 | 0.003 | 8.04 | 0.16 | 0.05 | 0.014 | 0.006 | 0.005 | 0.96 | — |
| 8 | 0.049 | 0.25 | 0.33 | 0.015 | 0.003 | 8.04 | 0.16 | 0.05 | 0.014 | 0.006 | 0.005 | 0.96 | — |
| 9 | 0.049 | 0.25 | 0.33 | 0.015 | 0.003 | 8.04 | 0.16 | 0.05 | 0.014 | 0.006 | 0.005 | 0.96 | — |
| | | | | | | Comparative Example | | | | | | | |
| 10 | 0.049 | 0.25 | 0.33 | 0.015 | 0.003 | 8.04 | 0.16 | 0.05 | 0.014 | 0.006 | 0.005 | 0.96 | — |
| 11 | 0.049 | 0.25 | 0.33 | 0.015 | 0.003 | 8.04 | 0.16 | 0.05 | 0.014 | 0.006 | 0.005 | 0.96 | — |
| 12 | 0.049 | 0.25 | 0.33 | 0.015 | 0.003 | 8.04 | 0.16 | 0.05 | 0.014 | 0.006 | 0.005 | 0.96 | — |
| 13 | 0.049 | 0.25 | 0.33 | 0.015 | 0.003 | 8.04 | 0.16 | 0.05 | 0.014 | 0.006 | 0.005 | 0.96 | — |
| | | | | | | Steel of This Invention | | | | | | | |
| 14 | 0.047 | 0.22 | 0.50 | 0.017 | 0.002 | 8.94 | 0.23 | 0.07 | 0.022 | 0.003 | 0.003 | — | 2.95 |
| 15 | 0.035 | 0.26 | 0.48 | 0.018 | 0.004 | 10.51 | 0.15 | 0.03 | 0.010 | 0.005 | 0.003 | 0.42 | 1.88 |
| 16 | 0.018 | 0.31 | 0.33 | 0.016 | 0.005 | 12.78 | 0.22 | 0.06 | 0.016 | 0.004 | 0.004 | — | — |
| 17 | 0.038 | 0.21 | 0.28 | 0.012 | 0.004 | 9.56 | 0.18 | 0.05 | 0.016 | 0.005 | 0.004 | — | — |
| 18 | 0.029 | 0.19 | 0.26 | 0.012 | 0.005 | 9.30 | 0.20 | 0.05 | 0.014 | 0.004 | 0.004 | — | — |
| 19 | 0.036 | 0.24 | 0.25 | 0.014 | 0.004 | 9.16 | 0.20 | 0.04 | 0.009 | 0.005 | 0.005 | 1.05 | — |
| 20 | 0.019 | 0.31 | 0.30 | 0.015 | 0.004 | 8.54 | 0.19 | 0.05 | 0.020 | 0.004 | 0.004 | 0.31 | 1.71 |
| 21 | 0.022 | 0.26 | 0.45 | 0.010 | 0.002 | 9.14 | 0.22 | 0.04 | 0.001 | 0.005 | 0.003 | — | — |
| 22 | 0.034 | 0.19 | 0.29 | 0.015 | 0.005 | 8.96 | 0.24 | 0.03 | 0.026 | 0.004 | 0.004 | — | — |
| 23 | 0.033 | 0.22 | 0.45 | 0.013 | 0.003 | 9.41 | 0.28 | 0.04 | 0.045 | 0.006 | 0.004 | — | — |
| 24 | 0.028 | 0.24 | 0.41 | 0.014 | 0.002 | 9.23 | 0.12 | 0.06 | 0.006 | 0.004 | 0.003 | — | — |
| 25 | 0.026 | 0.21 | 0.44 | 0.016 | 0.003 | 7.18 | 0.17 | 0.08 | 0.047 | 0.004 | 0.004 | — | 2.84 |
| 26 | 0.018 | 0.19 | 0.29 | 0.015 | 0.003 | 10.41 | 0.10 | 0.02 | 0.019 | 0.005 | 0.004 | 0.86 | — |
| 27 | 0.036 | 0.32 | 0.32 | 0.014 | 0.002 | 13.77 | 0.24 | 0.09 | 0.014 | 0.005 | 0.003 | 0.40 | 1.48 |
| 28 | 0.026 | 0.17 | 0.36 | 0.014 | 0.001 | 7.18 | 0.05 | 0.06 | 0.015 | 0.006 | 0.004 | — | — |
| 29 | 0.027 | 0.19 | 0.33 | 0.013 | 0.003 | 9.33 | 0.09 | 0.10 | 0.010 | 0.004 | 0.003 | — | — |
| 30 | 0.018 | 0.21 | 0.29 | 0.012 | 0.002 | 9.41 | 0.20 | 0.05 | 0.003 | 0.004 | 0.005 | — | — |
| | | | | | | Comparative Example | | | | | | | |
| 31 | *0.062 | 0.23 | 0.25 | 0.013 | 0.003 | 9.11 | 0.16 | 0.04 | 0.018 | 0.005 | 0.004 | — | — |
| 32 | *0.088 | 0.20 | 0.26 | 0.014 | 0.003 | 9.23 | 0.14 | 0.05 | 0.020 | 0.004 | 0.004 | 0.95 | 0.05 |
| 33 | *0.056 | 0.23 | 0.32 | 0.011 | 0.005 | 9.46 | 0.20 | 0.04 | *0.053 | 0.006 | 0.004 | — | — |
| 34 | *0.074 | 0.28 | 0.28 | 0.014 | 0.004 | 10.50 | 0.19 | 0.05 | *0.056 | 0.004 | 0.004 | — | — |

Note:
The mark * indicates values out of the invention.

TABLE 2

(Continuing of Table 1)

| No. | Chemical Composition (mass %, bal.: Fe and impurities) Ni | Cu | Co | Ca | Mg | B | Others | Normalizing | Tempering | Density of Precipitate ($\times 10^8$ particles/mm$^2$) | Hot Workability |
|---|---|---|---|---|---|---|---|---|---|---|---|
| | | | | | | | Steel of This Invention | | | | |
| 1 | — | — | — | — | — | — | — | 1180° C. × 0.5 h | 770° C. × 1 h | 0.126 | ○ |
| 2 | — | — | — | — | — | — | — | " | " | 0.302 | ○ |
| 3 | — | — | — | — | — | — | — | " | " | 0.156 | ○ |
| 4 | — | — | — | — | — | — | — | " | " | 0.070 | ○ |
| 5 | — | — | — | — | — | — | — | " | " | 0.102 | ○ |
| 6 | — | — | — | — | — | — | — | " | " | 0.148 | ○ |
| 7 | — | — | — | — | — | — | — | " | " | 0.310 | ○ |
| 8 | — | — | — | — | — | — | — | " | 770° C. × 3 h | 0.847 | ○ |
| 9 | — | — | — | — | — | — | — | " | — | 0.005 | ○ |
| | | | | | | | Comparative Example | | | | |
| 10 | — | — | — | — | — | — | — | " | 770° C. × 10 h | *2.069 | ○ |
| 11 | — | — | — | — | — | — | — | " | 700° C. × 10 h | *1.726 | ○ |
| 12 | — | — | — | — | — | — | — | 900° C. × 0.5 h | 770° C. × 1 h | *1.426 | ○ |
| 13 | — | — | — | — | — | — | — | 1180° C. × 0.5 h | 700° C. × 10 h | *1.968 | ○ |
| | | | | | | | Steel of This Invention | | | | |
| 14 | — | — | — | — | — | — | — | " | 770° C. × 1 h | 0.342 | ○ |
| 15 | — | — | — | — | — | — | — | " | " | 0.241 | ○ |
| 16 | 0.61 | — | — | — | — | — | — | " | " | 0.165 | ○ |
| 17 | 0.05 | 1.76 | — | — | — | — | — | " | " | 0.294 | ○ |
| 18 | — | — | 2.65 | — | — | — | — | " | " | 0.198 | ○ |
| 19 | — | — | — | — | — | — | — | " | " | 0.231 | ○ |
| 20 | 0.43 | 1.51 | — | — | — | — | — | " | " | 0.145 | ○ |
| 21 | — | — | — | — | — | — | — | " | " | 0.187 | ○ |
| 22 | — | — | — | — | — | — | — | " | " | 0.201 | ○ |
| 23 | — | — | — | — | — | — | — | " | " | 0.216 | ○ |
| 24 | — | — | — | — | — | — | — | " | " | 0.205 | ○ |
| 25 | — | — | 2.45 | — | — | 0.0010 | Nd: 0.026 | " | " | 0.215 | ○ |
| 26 | 0.96 | — | — | 0.0018 | — | — | — | " | " | 0.179 | ◎ |
| 27 | — | 1.88 | — | — | — | — | — | " | " | 0.325 | ○ |
| 28 | — | — | — | — | — | — | Ta: 0.048 | " | " | 0.166 | ○ |
| 29 | — | — | — | — | — | 0.0032 | " | " | " | 0.181 | ○ |
| 30 | — | — | — | — | 0.0023 | — | " | " | " | 0.136 | ◎ |
| | | | | | | | Comparative Example | | | | |
| 31 | — | — | — | — | — | — | — | " | " | *1.106 | ○ |
| 32 | — | — | — | — | — | — | — | " | " | *1.624 | ○ |
| 33 | — | — | — | — | — | — | — | " | " | *1.216 | ○ |
| 34 | — | — | — | — | — | — | — | " | " | *1.286 | ○ |

Note:
The Mark "*" indicates values of this invention.

First, specimens for structure observation were taken from each steel plate in the above-mentioned process, and 10 fields of view were observed at a magnification of 5000 using a scanning electron microscope (SEM). The sizes and number of carbides mainly of the $M_{23}C_6$ type and MX type carbonitrides were determined, and the density per mm$^2$ of the precipitation of those carbides and carbonitrides, which were not smaller than 0.3 $\mu$m in diameter (major axis) was determined. The results obtained are also shown in Table 2. Creep test specimens were also taken from each steel plate and subjected to creep testing.

Then, one side of each steel plate was subjected to edge preparation at an angle of 30° with a root face thickness of 1 mm. Two plates thus prepared were then butt-welded by the TIG method in the manner of multilayer welding, using a filler metal with the same composition as the corresponding steel plate, whereby a welded joint was produced for each steel plates. The welding heat input was 12–20 kJ/cm Neither preheating nor inter-pass temperature control was carried out. All the welded joints showed no defects after welding, namely no high temperature cracks or low temperature cracks or other defects. The filler metals were prepared from the corresponding steel plates by hot working and machining.

The welded joints produced were subjected to post-welding heat treatment by maintaining them at 740° C. for 0.5 hour. Then, creep test specimens were taken from the welds and subjected to creep testing. For some welded joints (No. 1–9 and 14–30), V-notched specimens specified in JIS Z 2202 were taken from the welded joints and subjected to a Charpy impact test. The creep test specimens were taken so that the weld line might be located in the middle in the longitudinal direction. The V-notched specimens were taken so that the melting boundary might be located on the notch bottom.

The creep test was carried out at 650° C., and the data obtained were linearly extrapolated in order to determine the estimated strength after 3000 hours. The strength of each base metal was compared with that of the welded joint, and the joint was evaluated as being satisfactory when the strength of the welded joint was 90% or more of that of the base metal, and as being unsatisfactory when less than 90%.

The Charpy impact test was carried out at −20° C., and the adsorbed energy was determined. When the adsorbed energy was not less than 40 J, the specimen was evaluated as satisfactory.

The results, obtained in the above manner, are shown together in Table 3.

TABLE 3

| No. | Extimated Creep Strength (MPa) Base Metal | Welded Joint | Ratio of Strength Welded Joint/ Base Metal | Absorbed Energy (J) at −20° C. |
|---|---|---|---|---|
| | | Steel of This Invention | | |
| 1 | 75 | 70 | 0.93 | 64 |
| 2 | 78 | 72 | 0.92 | 62 |
| 3 | 74 | 69 | 0.93 | 66 |
| 4 | 71 | 67 | 0.95 | 52 |
| 5 | 73 | 69 | 0.94 | 62 |
| 6 | 73 | 68 | 0.93 | 62 |
| 7 | 78 | 72 | 0.92 | 65 |
| 8 | 76 | 68 | 0.90 | 67 |
| 9 | 78 | 78 | 1.00 | 65 |
| | | Comparative Example | | |
| 10 | 15 | 49 | *0.65 | — |
| 11 | 78 | 55 | *0.70 | — |
| 12 | 76 | 55 | *0.72 | — |
| 13 | 76 | 52 | *0.68 | — |
| | | Steel of This Invention | | |
| 14 | 81 | 74 | 0.91 | 67 |
| 15 | 80 | 74 | 0.92 | 62 |
| 16 | 74 | 70 | 0.94 | 60 |
| 17 | 76 | 70 | 0.92 | 62 |
| 18 | 75 | 70 | 0.93 | 64 |
| 19 | 75 | 69 | 0.92 | 64 |
| 20 | 79 | 73 | 0.93 | 62 |
| 21 | 74 | 69 | 0.93 | 64 |
| 22 | 75 | 70 | 0.93 | 66 |
| 23 | 75 | 70 | 0.93 | 66 |
| 24 | 74 | 68 | 0.92 | 67 |
| 25 | 78 | 73 | 0.93 | 62 |
| 26 | 78 | 73 | 0.94 | 64 |
| 27 | 80 | 74 | 0.92 | 64 |
| 28 | 74 | 68 | 0.92 | 62 |
| 29 | 75 | 69 | 0.92 | 62 |
| 30 | 73 | 69 | 0.94 | 64 |
| | | Comparative Example | | |
| 31 | 78 | 62 | *0.80 | — |
| 32 | 79 | 51 | *0.65 | — |
| 33 | 78 | 62 | *0.79 | — |
| 34 | 78 | 59 | *0.75 | — |

Note:
The mark "*" indicates that the value is not satisfactory.

As is apparent from Table 3, for each of the welded joints Nos. 1–9 and 14–30 obtained by using the steel plates under the conditions specified by this invention, the estimated strength of the joint is not less than 90% of the estimated strength of the base metal. These welded joints had a sufficient level of toughness, with the absorbed energy measured at −20° C., which is not less than 52 J.

On the contrary, for the welded joints Nos. 10–13 obtained by using steel plates which showed a density of precipitates of carbides mainly of the $M_{23}C_6$ type and MX type carbonitrides with a grain diameter not smaller than 0.3 μm, which were outside the range specified herein due to inadequate heat treatment in steel plate production although the respective chemical compositions were within the range specified herein, the estimated strength of each joint was 65–72% of the strength of the corresponding base metal; the HAZ softening was remarkable For welded joints Nos. 31–34 obtained by using steel plates which showed a C and/or N content, and a density of precipitates of carbides mainly of the $M_{23}C_6$ type and MX type carbonitrides, with a grain diameter not smaller than 0.3 μm, both outside the ranges specified herein, the estimated strength of each joint was 65–80% of the estimated strength of the corresponding base metal and the HAZ softening was significant.

Industrial Applicability

The ferritic heat-resisting steels of the invention show a low level of decrease in creep strength in the welding heat affected zone. Therefore, they are useful as materials for the construction of welded structures such as boilers.

What is claimed is:

1. A ferritic heat-resisting steel that shows a low level of welding heat affected zone softening, and is characterized by consisting of, by mass %, C: less than 0.05%, Si: not more than 1.0%, Mn: not more than 2.0%, P: not more than 0.030%, S: not more than 0.015%, Cr: 7–14%, V: 0.05–0.40%, Nb: 0.01–0.10%, N: not less than 0.001% but less than 0.050%, sol. Al: not more than 0.010%, and O (oxygen): not more than 0.010%, with the balance being Fe and impurities, and further characterized in that the density of carbide and carbonitride precipitates contained therein with a grain diameter of not less than 0.3 μm is not more than $1\times10^6/mm^2$.

2. A ferritic heat-resisting steel according to claim 1 that contains either or both of Mo and W, with a total content of 0.1–5.0 mass % in lieu of part of Fe.

3. A ferritic heat-resisting steel according to claim 1 that contains one or more of Cu, Ni and Co, with a total content of 0.02–5.00 mass % in lieu of part of Fe.

4. A ferritic heat-resisting steel according to claim 1 that contains one or more of Ta, Hf, Nd and Ti, with a total content of 0.01–0.20 mass % in lieu of part of Fe.

5. A ferritic heat-resisting steel according to claim 1 that contains either or both of Ca and Mg, with a total content of 0.0005–0.0100 mass % in lieu of part of Fe.

6. A ferritic heat resisting steel according to claim 1 that contains 0.0005–0.0100 mass % of B in lieu of part of Fe.

* * * * *